US009004369B2

(12) United States Patent
Bortoletto et al.

(10) Patent No.: US 9,004,369 B2
(45) Date of Patent: Apr. 14, 2015

(54) SYSTEMS AND METHODS FOR MULTI-SENSE CONTROL ALGORITHM FOR ATOMIZERS IN REFRIGERATORS

(75) Inventors: Anderson Bortoletto, Waunakee, WI (US); Rameet Singh Grewal, Pune (IN); Guolian Wu, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1168 days.

(21) Appl. No.: 12/730,340

(22) Filed: Mar. 24, 2010

(65) Prior Publication Data

US 2011/0232304 A1 Sep. 29, 2011

(51) Int. Cl.
*G05D 22/02* (2006.01)
*F25D 17/04* (2006.01)

(52) U.S. Cl.
CPC .... *F25D 17/042* (2013.01); *F25D 2317/04131* (2013.01); *F25D 2500/04* (2013.01)

(58) Field of Classification Search
CPC ..... F25B 1/00; F25B 9/002; F25B 2700/00; F25B 2600/01; F25B 2600/23; F25B 2700/02; F25B 2600/02; F25B 47/02; F25D 17/042; F25D 2317/0413; F25D 2317/04131; F25D 2500/04; F25D 21/00; F25D 29/00; F25D 2700/00; F25D 21/02; F25D 21/008; F24F 3/14
USPC ..... 62/78, 80, 91, 115, 129, 140, 151, 153, 62/155, 157, 158, 176.1, 176.2, 176.6, 62/228.1, 234, 274, 440, 498; 236/44 C
See application file for complete search history.

(56) References Cited

U.S. PATENT DOCUMENTS

| | | | | | |
|---|---|---|---|---|---|
| 2,454,855 | A | | 11/1948 | Bauman | |
| 2,493,488 | A | | 1/1950 | Jordan et al. | |
| 3,879,857 | A | | 4/1975 | Neville | |
| 4,138,858 | A | | 2/1979 | Izumi | |
| 4,250,719 | A | | 2/1981 | Grimm et al. | |
| 4,528,821 | A | * | 7/1985 | Tershak et al. | 62/153 |
| 4,557,118 | A | | 12/1985 | Pink et al. | |
| 4,612,777 | A | | 9/1986 | Noma et al. | |
| 4,630,451 | A | | 12/1986 | Kishimoto | |
| 4,731,204 | A | | 3/1988 | Noma et al. | |
| 4,738,806 | A | | 4/1988 | Noma et al. | |
| 4,860,555 | A | | 8/1989 | Bishop et al. | |
| 5,093,080 | A | | 3/1992 | Keller | |
| 5,300,561 | A | * | 4/1994 | Singh et al. | 524/765 |
| 5,303,563 | A | | 4/1994 | Bishop et al. | |
| 5,417,080 | A | | 5/1995 | Bishop | |
| 5,457,963 | A | | 10/1995 | Cahill-O'Brien et al. | |
| 5,675,503 | A | | 10/1997 | Moe et al. | |

(Continued)

FOREIGN PATENT DOCUMENTS

| | | | | | |
|---|---|---|---|---|---|
| GB | 2207514 | A | * | 2/1989 | G01N 25/68 |
| JP | 06257933 | A | * | 9/1994 | F25D 23/00 |
| KR | 20000021928 | A | * | 4/2000 | F25D 23/00 |

*Primary Examiner* — Frantz Jules
*Assistant Examiner* — Azim Abdur Rahim

(57) ABSTRACT

A method and system is provided which receives a desired humidity level from a user for the refrigeration compartment of a refrigerator, determines the current humidity level, and then activates an atomizer in the refrigeration compartment to increase the humidity level if needed. The humidity in the refrigeration compartment may be determined based at least in part on the temperature of the refrigeration compartment, the defrost timer, the door opening times, and the compressor timer.

20 Claims, 12 Drawing Sheets

(56) References Cited

U.S. PATENT DOCUMENTS

| | | | |
|---|---|---|---|
| 5,974,815 | A | 11/1999 | Hwang et al. |
| 6,038,865 | A | 3/2000 | Watanabe et al. |
| 6,106,775 | A | 8/2000 | Fuller |
| 6,390,378 | B1 | 5/2002 | Briscoe, Jr. et al. |
| 6,406,006 | B1 | 6/2002 | Dettling et al. |
| 6,904,761 | B2 | 6/2005 | Rafalovich et al. |
| 7,216,021 | B2 | 5/2007 | Matsubara et al. |
| 7,296,422 | B2 | 11/2007 | Strohm et al. |
| 7,401,469 | B2 | 7/2008 | Joshi et al. |
| 7,607,312 | B2 | 10/2009 | Wetekamp et al. |
| 7,608,217 | B2 | 10/2009 | Champagne |
| 2008/0159910 | A1 | 7/2008 | Dick et al. |
| 2008/0178621 | A1 | 7/2008 | Kang |
| 2008/0196427 | A1 | 8/2008 | Bianchi et al. |
| 2008/0223953 | A1 | 9/2008 | Tomono et al. |
| 2008/0233001 | A1 | 9/2008 | Ricciardi et al. |
| 2008/0290189 | A1 | 11/2008 | Levi |
| 2009/0001200 | A1 | 1/2009 | Imahori et al. |
| 2009/0142458 | A1 | 6/2009 | McCann |
| 2010/0077791 | A1* | 4/2010 | Kamisako et al. ..... 62/373 |

* cited by examiner

Open Loop Control

Close Loop Control with Humidity Feedback

SYSTEMS AND METHODS FOR MULTI-SENSE CONTROL ALGORITHM FOR ATOMIZERS IN REFRIGERATORS

BACKGROUND OF THE INVENTION

The present disclosure generally relates to a refrigerator. More particularly, the present disclosure relates to a refrigerator with an improved system for keeping food fresh.

In this regard, it has been determined that some refrigerated foods remain fresh and attractive to the consumer when the foods are exposed to water or moisture on a regular basis. However, the interior of the refrigeration compartment of a refrigerator is typically quite dry.

Moreover, it is often the case that additional moisture is undesirable in prior art refrigerators because it may make the cooling process more energy-intensive. Also, even when not directly designed to remove water or moisture, many refrigerators tend to minimize moisture purely as a by-product of their operation.

BRIEF SUMMARY OF THE INVENTION

One or more of the embodiments of the present disclosure provide a control system and method for determining when the humidity level in the interior of the refrigeration compartment of a refrigerator is below a desired level and then actuating an atomizer to raise the humidity level. More specifically, the system for determining the humidification level may be based at least in part on the temperature of the refrigeration compartment, the defrost timer, the door opening times, and the compressor timer.

DETAILED DESCRIPTION OF THE INVENTION

Figure 1:
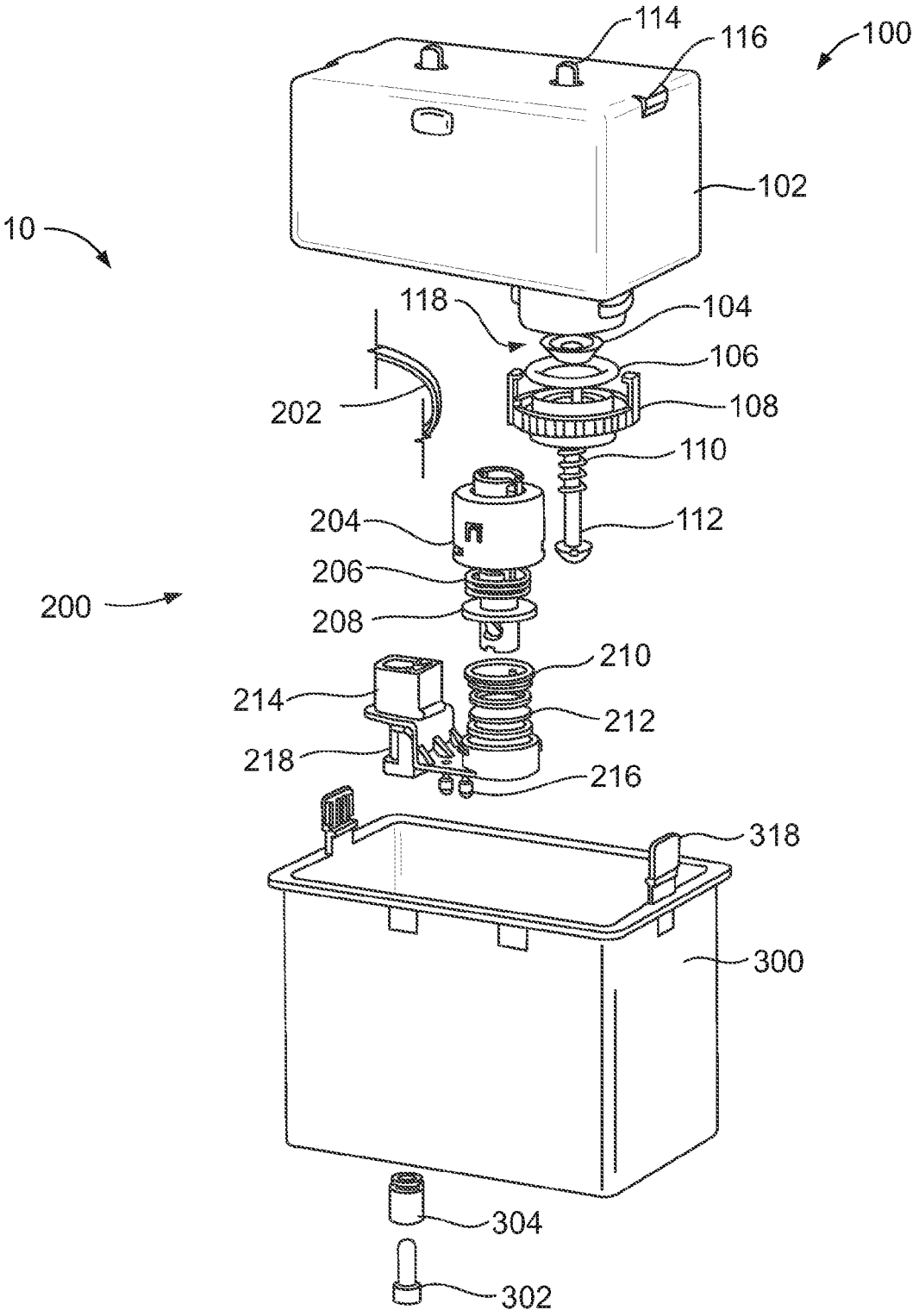
FIG. 1 illustrates an atomization unit formed in accordance with an embodiment of the present disclosure.

FIG. 1 illustrates an atomization unit 10 formed in accordance with an embodiment of the present disclosure. The illustrated atomization unit 10 is a modular design that is configured and adapted to be added to or removed from a refrigerator as a unit. The atomization unit 10 comprises a water tank assembly 100, a water delivery assembly 200, and a docking station 300. In the illustrated embodiment, the docking station 300 is adapted to securely receive the water tank assembly 100 and the water delivery assembly 200. In turn, the docking station 300 may be securely mounted in a refrigerator.

Figure 3:
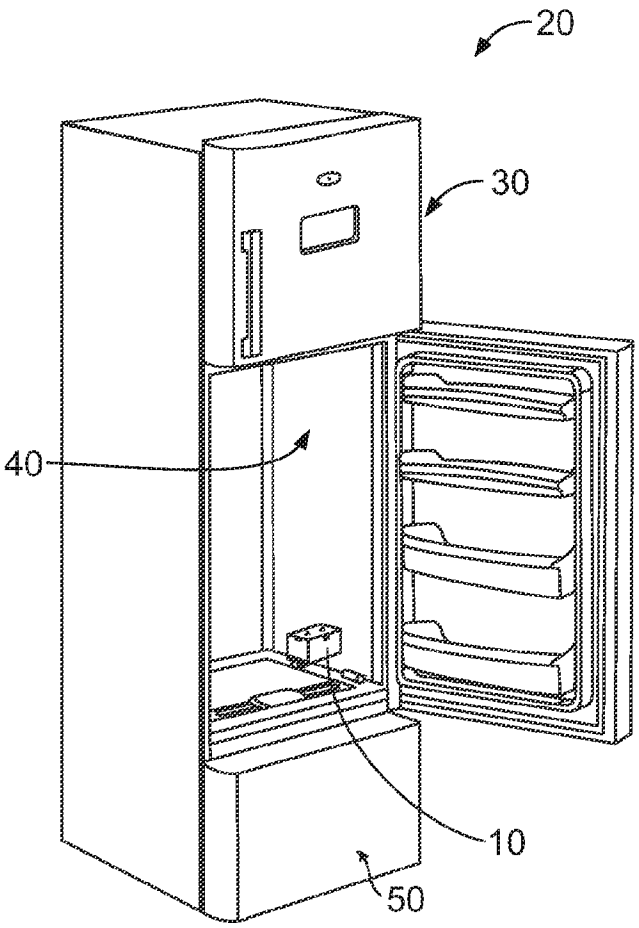
FIG. 3 illustrates a refrigerator to which the atomization unit of FIG. 1 may be added to or removed from, with the atomization unit being removed from the refrigerator.
Figure 2:
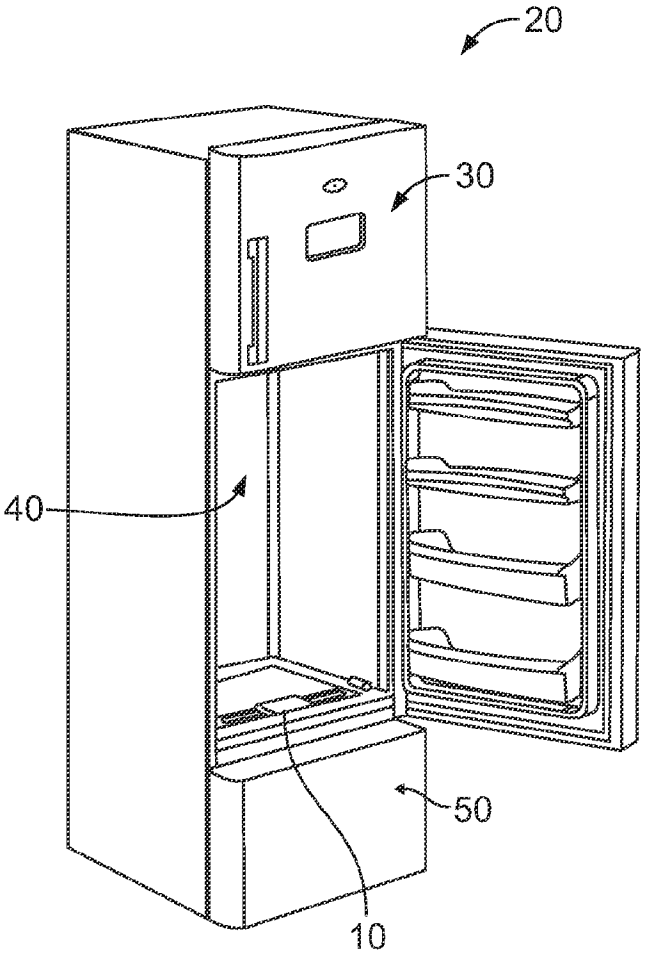
FIG. 2 illustrates a refrigerator to which the atomization unit of FIG. 1 may be added to or removed from, with the atomization unit in place in the refrigerator.

FIGS. 2 and 3 illustrate a refrigerator 20 to which the atomization unit 10 may be added to or removed from. In FIG. 2, the atomization unit 10 is shown in place, in an assembled condition, in the refrigerator 20. In FIG. 3, the atomization unit 10 is illustrated as being removed from the refrigerator 20. The atomization unit 10 may be removed from the refrigerator 20, for example, for service, maintenance, or replacement. In certain embodiments, the atomization unit 10 may be removed from the refrigerator 20 to be refilled with a fluid, such as water. In other embodiments, the atomization unit 10 may be re-fillable without removal from the refrigerator, such as, for example, by plumbing provided within the refrigerator 20, or by a user pouring water into the atomization unit 10, or, as another example, by the attachment of a replaceable bottle or other filling device to the atomization unit 10. The atomizer unit 10 may have a footprint of, for example, about 75 millimeters by about 120 millimeters. The relatively small footprint of the atomizer unit 10 and/or the modularity of the atomizer unit 10 also allow for easier retrofitting to a refrigerator not previously designed for use with an atomizer unit to accept and use the atomizer unit 10.

For the illustrated embodiment, the refrigerator 20 includes a freezer compartment 30 located at a generally higher elevation, a refrigeration compartment 40 located at a generally intermediate level, and a refrigeration/humidification compartment 50 located at a generally lower level. The atomization unit 10 is securable at an intermediate position between the refrigeration compartment 40 and the refrigeration/humidification compartment 50, and disperses a spray of fluid generally downwardly into the refrigeration/humidification compartment 50. In such an arrangement, for example, the atomization unit may be supplied with water from a defrosting process in a compartment located at a higher level, the water being gravity fed to the atomization unit 10. Other refrigeration arrangements may be employed in other embodiments. As just one example, an atomization unit may be located proximate a side wall of a refrigeration compartment.

Additionally or alternatively, the refrigerator compartment and atomization unit may be configured and adapted so that some subcompartments of a larger compartment are supplied with atomized fluid and some are not, or further that subcompartments may be supplied with atomized fluid at different rates or amounts. Such subcompartments may be defined, for example, by bins, trays, and/or shelves dispersed throughout a compartment. The various compartments may be differently sized and/or arranged in other embodiments. As just one example, a refrigerator formed in accordance with other embodiments may not comprise a separate refrigerator/humidification compartment, but may instead comprise a freezer unit and a refrigerator unit arranged in a side-by-side fashion, with an atomization unit providing humidification to all or part of the refrigeration unit.

Figure 4:
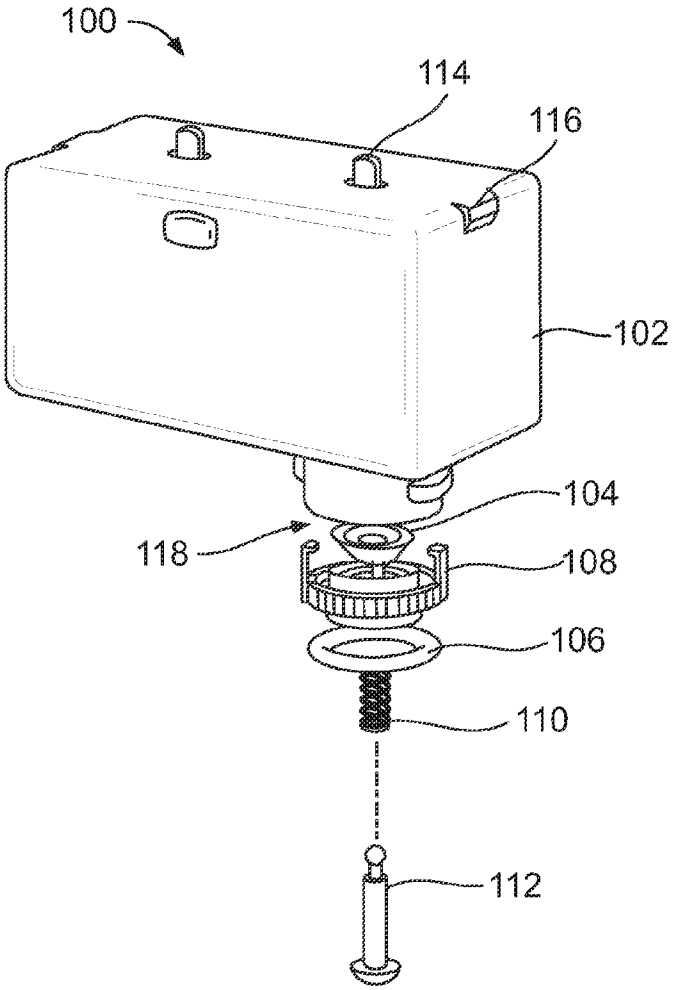
FIG. 4 illustrates an exploded perspective view of a water tank assembly formed in accordance with an embodiment of the present disclosure.

Returning to FIG. 1, as also indicated above, the atomization unit 10 comprises a water tank assembly 100, a water delivery assembly 200, and a docking station 300. FIG. 4 illustrates an exploded perspective view of the water tank assembly 100. The water tank assembly 100 includes a water tank 102, a poppet valve seal 104, an o-ring 106, a water tank cap 108, a poppet valve spring 110, a poppet valve 112, ears 114, and tabs 116.

The water tank 102 is configured and adapted to hold a volume of fluid. The water tank 102 is an example of a primary fluid reservoir or main supply fluid tank. As such, the water tank 102 should be constructed to be water tight, especially around its sides and bottom, to prevent leakage. The water tank 102 comprises one or more locations for the controlled entry and/or exit of fluid. Further, in the illustrated embodiment, the water tank 102 is configured to be airtight when the opening 118 is closed to the entry of air, for example, by being shut by a valve or submersed below a liquid level. The illustrated water tank 102 comprises an opening 118 located proximate the bottom of the water tank 102, which is sized and adapted to accept the water tank cap 108 and related components to allow for the controlled dispensing of water from the water tank 102. The water tank 102 may be inverted, with the water tank cap 108 removed, to be manually filled with water. In other embodiments, for example, the water tank 102, may be re-filled manually through a separate or additional cap accessible when the atomizer unit 10 is in place in the refrigerator, by a plumbing feed from water from another portion of the refrigerator or an external supply, and/or by a replaceably attachable supply such as a bottle. In other embodiments, for example, a replaceable supply such as a bottle may act as a supply of water without the use of a separate primary water tank.

In the illustrated embodiment, the ears 114 are located proximate to an external top surface of the water tank 102, and provide a convenient access point for handling the atomizer unit 10 during installation to and removal from the refrigerator 20. The ears 114 also provide a convenient access point for removing and/or installing the water tank 102 to the docking assembly 300. The tabs 116 are configured to help guide the water tank 102 into place into the docking station 300, and are configured to help secure the water tank 102 in place in the docking station 300.

As also previously mentioned, the water tank assembly 100 includes a poppet valve seal 104, an o-ring 106, a water tank cap 108, a poppet valve spring 110, and a poppet valve 112. The water tank cap 108 is sized and configured to cooperate with the opening 118 of the water tank 102 to allow fluid flow when the poppet valve 112 is open, and to prevent fluid flow when the poppet valve 112 is closed. The poppet valve seal 104, o-ring 106, water tank cap 108, and poppet valve spring 110 cooperate to prevent fluid flow when the poppet valve 112 is in a closed position. For example, the seals and o-ring are configured to help provide a waterproof barrier. The poppet valve spring 110 is configured to urge the poppet valve 112 in a closed position, and the poppet valve seal 104 is mounted to the poppet valve 112 so that the poppet valve seal 104 moves with the poppet valve 112.

In the illustrated embodiment, the poppet valve seal 104 is generally funnel shaped and configured to prevent flow through the water tank cap 108 when the poppet valve 112 is in a closed position. The funnel shape helps properly seat the poppet valve seal 104 with the assistance of downward pressure provided by a water column above it, when the poppet valve 112 is in a closed position. As shown in FIGS. 1 and 4, the poppet valve spring 110 is configured to bias the poppet valve 112 downward, thus drawing the poppet valve seal 104 down over an opening in the water tank cap 108.

The poppet valve 112 is opened by pressing upward on the poppet valve 112 against the urging of the poppet valve spring 110, thereby moving the poppet valve seal 104 (which is mounted to the poppet valve 112) upward and away from the opening in the water tank cap 108, thereby allowing fluid flow. Thus, when fluid flow is desired, the poppet valve 112 may be urged against the poppet valve spring 110 to an open position to allow fluid flow through the water tank cap 108. Once fluid flow is desired to be stopped, the poppet valve 112 may be returned to a closed position, where the poppet valve spring 110 will help close it and maintain it in place. In other embodiments, different valve arrangements and/or cap opening/closing arrangements and/or fluid flow mechanisms may be employed.

Figure 5:
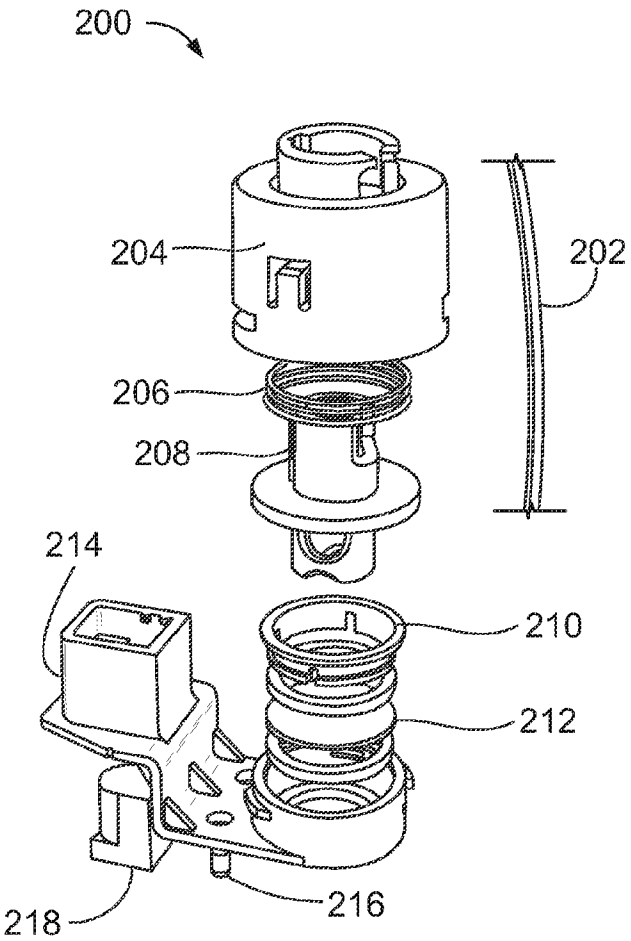
FIG. 5 illustrates an exploded perspective view of a water delivery assembly formed in accordance with an embodiment of the present disclosure.

FIG. 5 illustrates an exploded perspective view of the water delivery assembly 200. In the illustrated embodiment, the water delivery assembly includes a wick 202, a wick holder 204, a wick spring 206, a wick plunger 208, a piezo compression ring 210, a piezo cell 212, a piezo casing 214, and light emitting diodes (LEDs) 216. The water delivery assembly 200 in the illustrated embodiment is modular, and may be assembled and removed from and/or installed into the docking station 300 as a unit.

The wick 202 is configured to be a flexible member with sufficient absorbency to be able to deliver fluid from a reservoir to the piezo cell 212. The wick 202, for example, may be constructed of a cotton material, such as material from Pepperell Braiding Co., which can range in size, for example, from about 1/16 inch to about ½ inch and may be capable of drawing water up to about 8 inches. The wick holder 204, wick spring 206, and wick plunger 208 are configured and adapted to maintain one end of the wick 202 in proximity to the piezo cell 212, so that the wick 202 may act as a fluid conduit to the piezo cell 212. The wick holder 204 and/or other components provide an example of a wick guide.

The wick 202 is positioned such that one end of the wick 202 is in fluid communication with a source of fluid, and the other end is proximate to the piezo cell 212, so that the fluid is provided from a source of fluid to the piezo cell 212 via the wick 202. In certain embodiments, the wick is securely attached to the piezo cell, or element. In other embodiments, the wick is not securely attached to the piezo cell, but is positioned close enough to the piezo cell to provide water or other fluid. For example, the piezo casing may define a piezo reservoir that is supplied by the wick and maintains a volume of water proximate to the piezo cell.

The piezo casing 214 and piezo compression ring 210 cooperate to help maintain the piezo cell 212 in a desired position. The piezo casing 214 also includes a female docking pin 218 adapted to help secure the water delivery assembly 200 in place in the docking assembly 300. The piezo cell 212 is a relatively thin, perforated disk that, when stimulated vibrates, whereby fluid from a top surface of the piezo cell 212 is drawn through the perforations and distributed in an atomized spray from a bottom surface of the piezo cell 212. For example, the piezo cell 212 may be about 20 millimeters in diameter and between about 0.65 and about 0.83 millimeters thick. The perforations may be sized, for example, from about 8 to about 12 microns. The piezo cell 212 may have an activating frequency of about 110 Kilohertz, and may provide a misting rate of greater than about 10 cubic centimeters per hour. Perforations above about 12 microns may increase the possibility of leakage, while perforations under about 6 microns may contribute to clogging, thereby shortening the effective life. This atomized fluid may then be used to provide moisture in an easily accepted form to foodstuffs in an appropriate compartment that is supplied with an atomizer.

The wick holder 204 and related components cooperate with the piezo casing 214 and related components to form a modular unit that may be handled as a unit, and helps maintain the piezo cell 212 in proper position. For example, the wick plunger 208 may urge against the piezo compression ring 210 to help maintain the piezo cell 212 in place as well as to help prevent any leakage from the water delivery assembly 200. The wick holder 204 may be snappably and removable received by the piezo casing 214. The LEDs 216 light to provide information regarding the status and/or function of the piezo cell 212.

As shown in FIG. 1, the docking station 300 includes a male docking pin 302 and grommet 304 configured to cooperate with the female docking pin 218 to secure the water delivery unit 200 in place. The grommet 304 helps maintain water-tightness through the opening of the docking station 300 that accepts the male docking pin 302 and grommet 304. Docking station 300 also includes snaps 318 that cooperate with the ears 114 of the water tank 102 to help guide, place, and secure the water tank 102 to the docking station 300. With the water tank assembly 100 and water delivery assembly 200 in place in the docking station 300, the assembled components form a modular assembly that can be conveniently attached to and removed from the refrigerator 20. The modular design of the entire unit as well as various modular subassemblies also simplifies repairs and maintenance, as well as easing the process of retrofitting the unit to a refrigerator not originally designed to accommodate such a unit.

Figure 6:
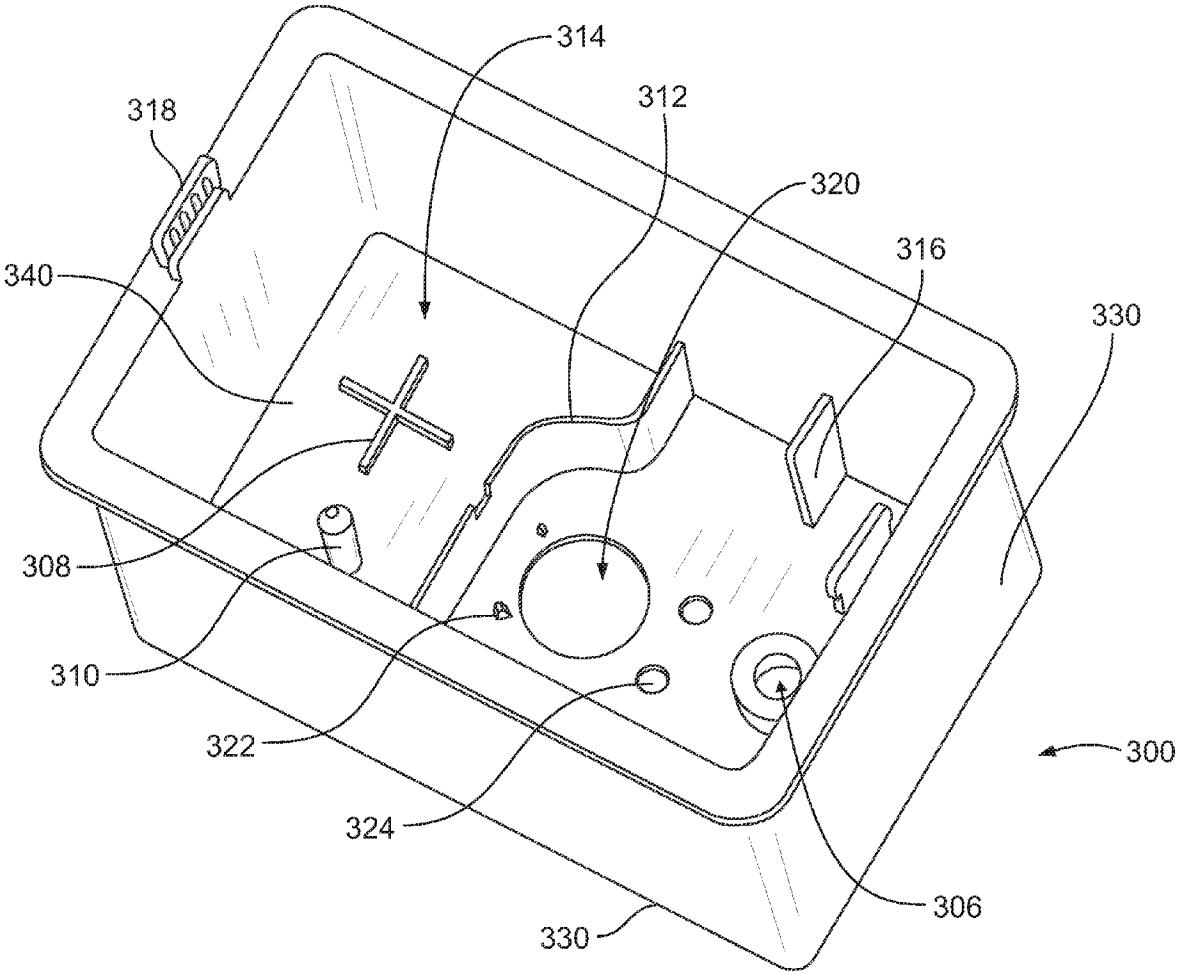
FIG. 6 illustrates a perspective view of a docking station formed in accordance with an embodiment of the present disclosure.

FIG. 6 illustrates a perspective view of a docking station 300. The docking station 300 of the illustrated embodiment includes side walls 330 that extend from a base 340 to define an open volume. The docking station 300 is configured to accept the water delivery assembly 200 and the water tank assembly 100. In the illustrated embodiment, the docking station 300 is molded as a single piece. The docking station 300 comprises a water delivery assembly mounting hole 306, a valve projection 308, a switch projection 310, a reservoir wall 312, a docking station reservoir 314, ribs 316, snaps 318, a piezo opening 320, and mounting features 322, 324.

The water delivery assembly mounting hole 306 is configured to cooperate with the female docking pin 218, male docking pin 302, and grommet 304 to help secure the water delivery assembly 200 in place in the docking station 300. Additionally, the illustrated embodiment includes mounting features 322, 324 to help guide, located, and/or secure the water delivery assembly 200 in place in the docking station 300. As shown in FIG. 6, mounting features 322 comprise raised surfaces and mounting features 324 comprise holes in the base 340 of the docking station 300. Further, the docking station 300 is configured to allow wiring for power supply and control to be connected to the water delivery assembly 200.

The valve projection 308 extends from the base 340 of the docking station 300, and is positioned and configured to press against the bottom of the poppet valve 112 when the water tank assembly 100 is lowered into place in the docking station 300. The atomization unit 10 is configured so that, when the water tank assembly 100 is securely positioned in place in the docking unit 300, the poppet valve 112 is urged upward by contact with the valve projection 308 into an open position thereby allowing fluid flow. In alternative arrangements, for example, the docking station reservoir 300 (or other reservoir with which a wick is in fluid communication) may be provided with water from a source other than a water tank, such as via municipally provided water via plumbing into the refrigerator, or water obtained from a defrosting process elsewhere in the refrigerator.

The switch projection 310 extends upward from the base 340 of the docking station 300. The switch projection 310 cooperates with a reed switch (not shown) to indicate the position of the water tank 102, for example, to indicate whether or not the water tank 102 is in its secure, assembled position within the docking station 300.

The reservoir wall 312 is a generally vertical wall that extends upward from the base 340, and together with portions of the base 340 and side walls 330 defines a docking station reservoir 314. The docking station reservoir 314 is an example of a secondary reservoir that accepts fluid from a primary reservoir or main supply, such as a water tank, and from which fluid is provided to an atomizer via the wick 202. In the illustrated embodiment, the docking station reservoir 314 is integrally formed with the docking station 300.

In other embodiments, a secondary reservoir that is not integrally formed with a docking station may also be employed. The reservoir wall 312 extends from the base 340 to a height that is low enough to not interfere with the placement of the water tank 102 in the docking assembly 300, but high enough to retain water in the docking station reservoir 314 without water spilling over the top of the reservoir wall 312. As will be appreciated further below, the reservoir wall 312 in the illustrated embodiment extends to a height such that its top is located at an elevation higher than the opening through the water tank cap 108 when the water tank 102 is in its secured, assembled position in the docking station 300.

The ribs 316 extend upward from the base 340 of the docking station and are configured to provide support to the water tank 102 when the water tank 102 is placed in the docking station 300. The ribs 316 also provide a positive stop to help prevent the water tank 102 from being pressed too deeply into the docking station 300 and damaging portions of the water delivery assembly 200.

The snaps 318 extend upward from the sides of the docking unit 300. The snaps are configured to be resiliently biasable, and to cooperate with the tabs 116 of the water tank 102 to secure the water tank 102 in place to the docking station 300.

The piezo opening 320 extends through the base 340 and is configured to provide an opening for the piezo cell 212, so that an atomized spray from the piezo cell 212 may be delivered to a desired location in a refrigerator.

Figure 8:
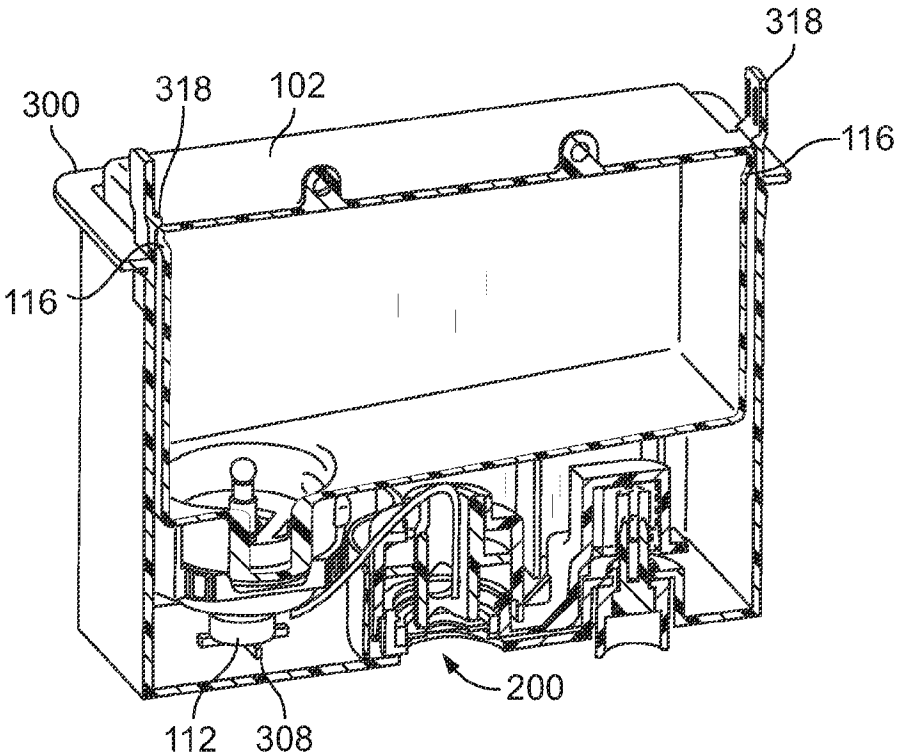
FIG. 8 illustrates a sectional view of the atomization unit of FIG. 1 with the water tank assembly securely positioned in the docking station.
Figure 7:
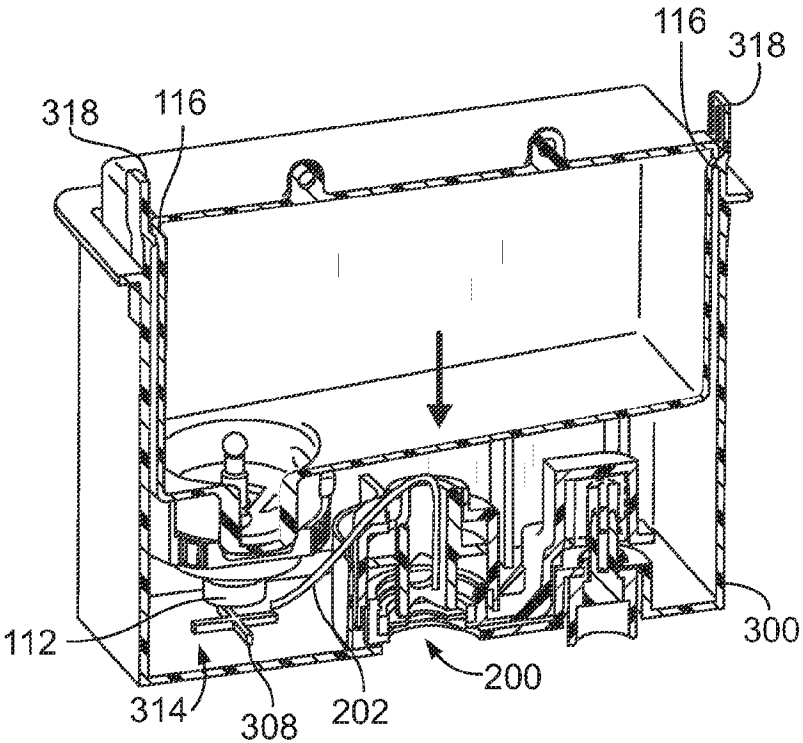
FIG. 7 illustrates a sectional view of the atomization unit of FIG. 1 as the water tank assembly is being inserted into the docking station.

The assembly of the atomization unit 10 may be accomplished as discussed below. FIG. 7 illustrates a sectional view of the atomization unit 10 as the water tank assembly 100 is being inserted into the docking station 300, and FIG. 8 illustrates a sectional view of the atomization unit 10 with the water tank assembly 100 securely positioned in the docking station 300. The water delivery system 200 may be assembled, positioned, and secured in place to the docking station 300, with one of the wick 202 proximate the piezo cell 212, and the other end of the wick 202 positioned in the docking station reservoir 314 where the wick 202 will be in fluid communication with a liquid supply to provide liquid to the piezo cell 212. The docking station 300 may then be securely positioned in the refrigerator 20, and all necessary connections made to provide power and/or control to the water delivery system 200. As an alternative, the water tank assembly 100 may be positioned in the docking station 300 before the docking station 300 is positioned in the refrigerator 20.

Before installing the water tank assembly 100, the water tank 102 may be filled with water. To fill, the water tank 102 is inverted so that the opening faces upward, and the water tank cap 108 and related components are removed from the water tank 102, providing access to the opening. A desired amount of water is then poured into the water tank 102, and the water tank cap 108 and related components are re-positioned on the water tank 102. With the water tank cap 108 securely fastened to the water tank 102 and the poppet valve spring 110 urging the poppet valve 112 into a closed position, the opening is closed and the water tank 102 is sealed, so that it may transferred without spillage.

The water tank 102 is then oriented for installation, with the water tank cap 108 oriented downward and aligned over the valve projection 308. As shown in FIG. 7, the water tank assembly 100 is then lowered in place into the docking station 300. Eventually, as the water tank assembly 100 is lowered, the poppet valve 112 will come into contact with the valve projection 308 to initiate opening of the poppet valve 112. Also, during the lowering, the tabs 116 of the water tank 102 encounter the snaps 318 of the docking station 300, and as the water tank 102 is further lowered, the tabs 116 press against the snaps 318, resiliently biasing the snaps 318 outwardly. For example, the tabs 116 may comprise sloped surfaces to assist in biasing the snaps 318 outwardly. As the water tank reaches its final, secured position, the tabs 116 pass beyond the snaps 318, allowing the snaps 318 to resiliently snap back into their original position, helping secure the water tank 102 in place.

At the same time, as the water tank 102 reaches its final, secured position, the poppet valve 112 is moved into its open position by its contact with the valve projection 308. With the poppet valve 112 in its open position, liquid flows from the water tank 102 through the opening in the water tank cap 108 into the docking station reservoir 314. Thus, the poppet valve 112 is an example of a secondary reservoir supply valve. The liquid continues to flow and fill the docking station reservoir 314 until the liquid rises to a level high enough to cover the opening in the water tank cap 108, such that the opening is not exposed to atmospheric pressure but is instead surrounded by liquid. At this point, atmospheric pressure acting on the top of the liquid in the docking station reservoir 314 is sufficient to prevent any further flow into the docking station reservoir 314. Thus, the atomization unit 10 is configured to provide a maximum, controlled height of fluid in the docking station reservoir 314.

As liquid is removed from the docking station reservoir via the wick 202 (which delivers liquid to the piezo cell 212 from where it is atomized into at least a portion of a refrigerator) water from the water tank 102 will replenish the docking station reservoir 314 to maintain the water level in the docking station reservoir 314 at a height sufficient to shield the opening in the water tank cap 108 from atmospheric pressure. The atomization unit 10 may be configured to maintain the level of water in the docking station reservoir 314 below a certain height to prevent water at too high of a pressure from being delivered to the piezo cell 212. For example, certain piezo cells do not function properly when exposed to water pressure caused by a head of about 3 inches.

Thus, in certain embodiments, the atomization unit 10 is configured so that the level of water in the docking station reservoir 314 is maintained at a level below about 3 inches. In other embodiments, for example, the opening and closing of a valve from the water tank may be controlled by sensors and switches based on the level of water in the secondary reservoir. For example, the valve may be opened when the level of water falls below a certain height, and closed when the level reaches a second height. In other embodiments, sensors may send signals to control the flow of water into the docking station reservoir 314 from an external supply via plumbing into the refrigerator.

With the atomizer unit 10 in place, an atomized spray may now be provided to a desired portion or portions of a refrigerator. The atomizer unit 10 defines a fluid flow path from the water tank 102, through the water tank cap 108 and into the docking station reservoir 314, and from the docking station reservoir 314 to the piezo cell 212 via the wick 202. The piezo cell 212 then may deliver an atomized spray.

Figure 9:
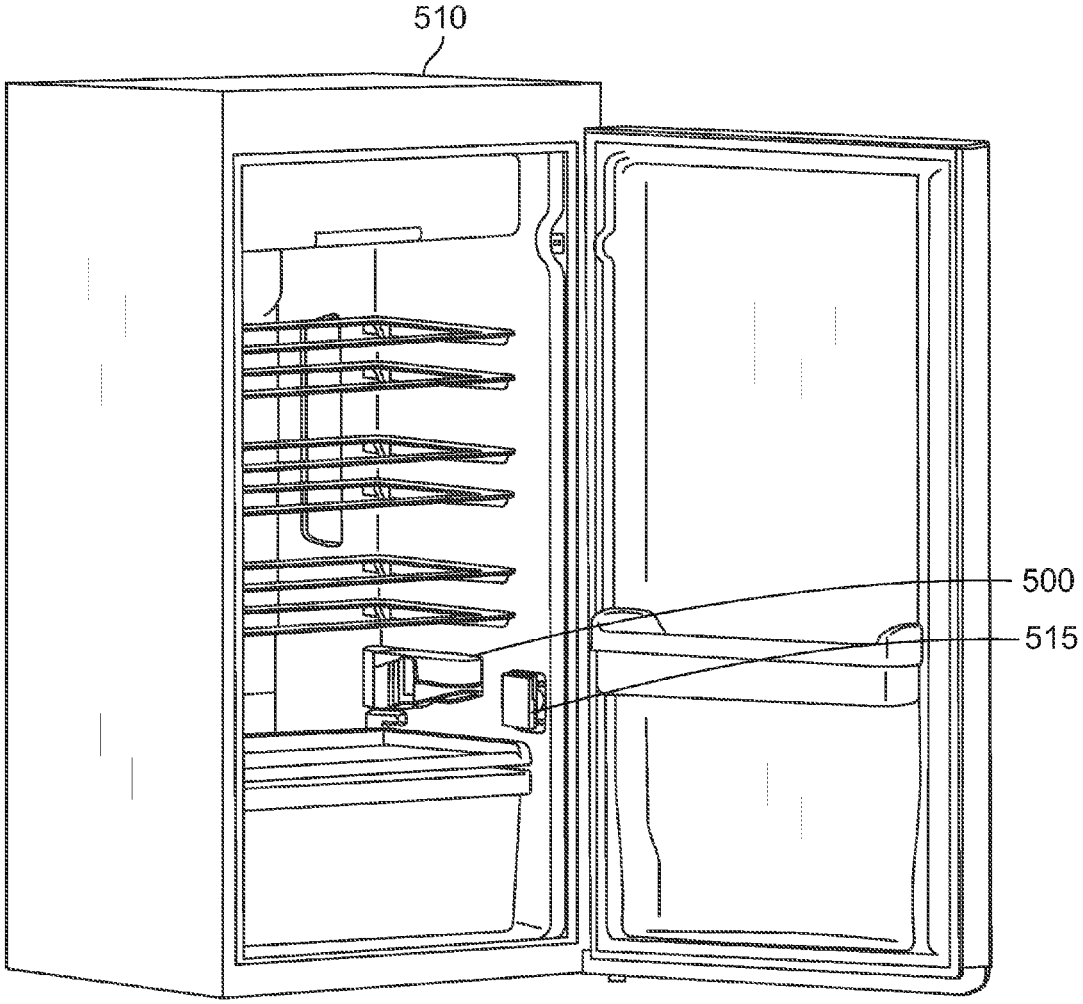
FIG. 9 illustrates an atomizer unit formed in accordance with an embodiment of the present disclosure in position in a refrigerator.

FIG. 9 illustrates another embodiment of an atomizer unit 500 in position in a refrigerator 510. As shown in FIG. 9, the atomizer unit 500, when positioned in the refrigerator 510, is positioned proximate a side wall of the refrigerator 510. While differing in some respects from the atomizer unit 10, the atomizer unit 500 may also have certain similar components to the atomizer unit 10, and may function in a generally similar manner to above discussed embodiments. As also shown in FIG. 9, the refrigerator 510 includes a control unit 515. The control unit 515 may be used to control the times at which the atomizer is turned on and off, and may optionally provide a user interface for adjusting the operating settings of the atomizer.

Figure 10:
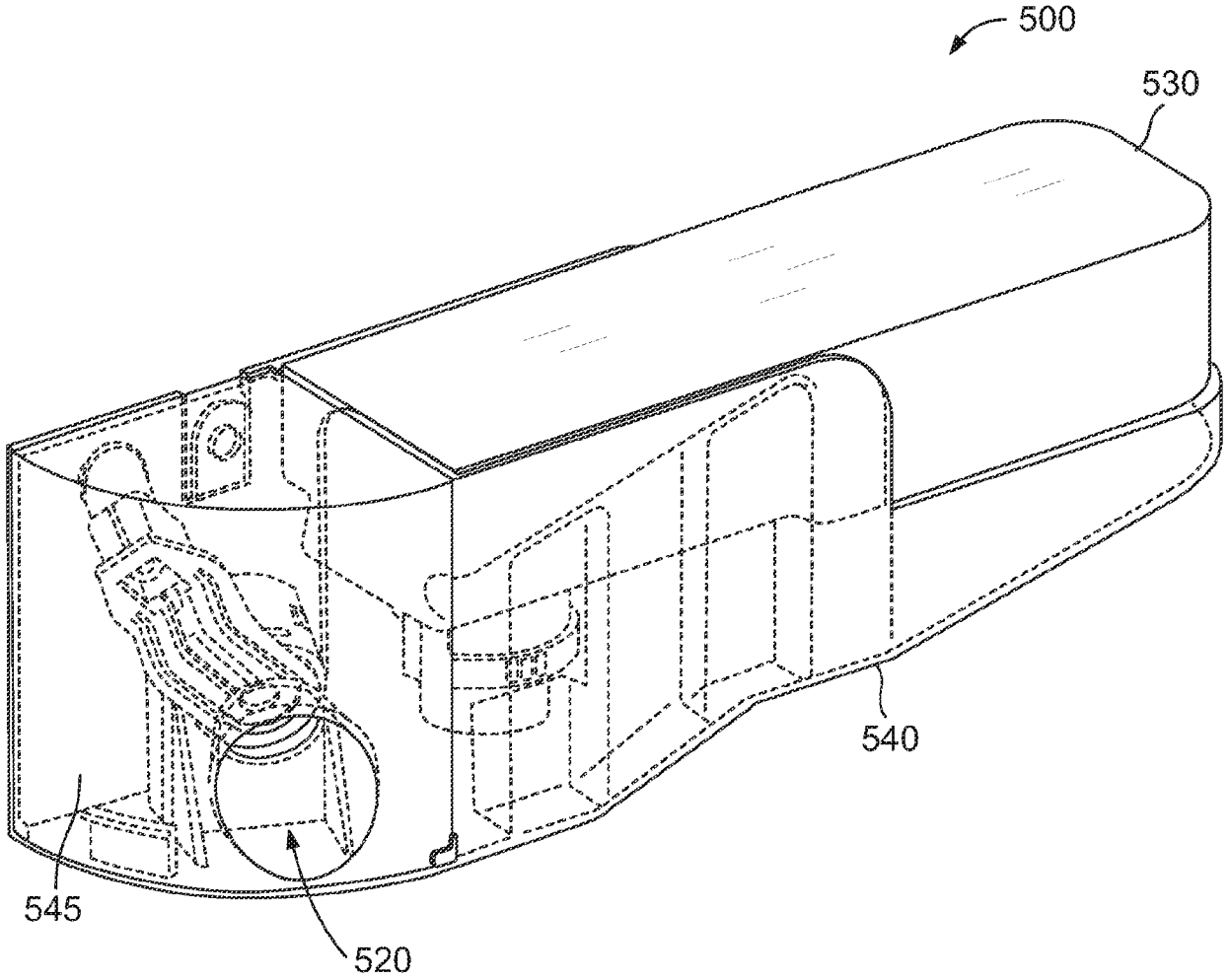
FIG. 10 illustrates a perspective view of the atomizer unit of FIG. 9.
Figure 11:
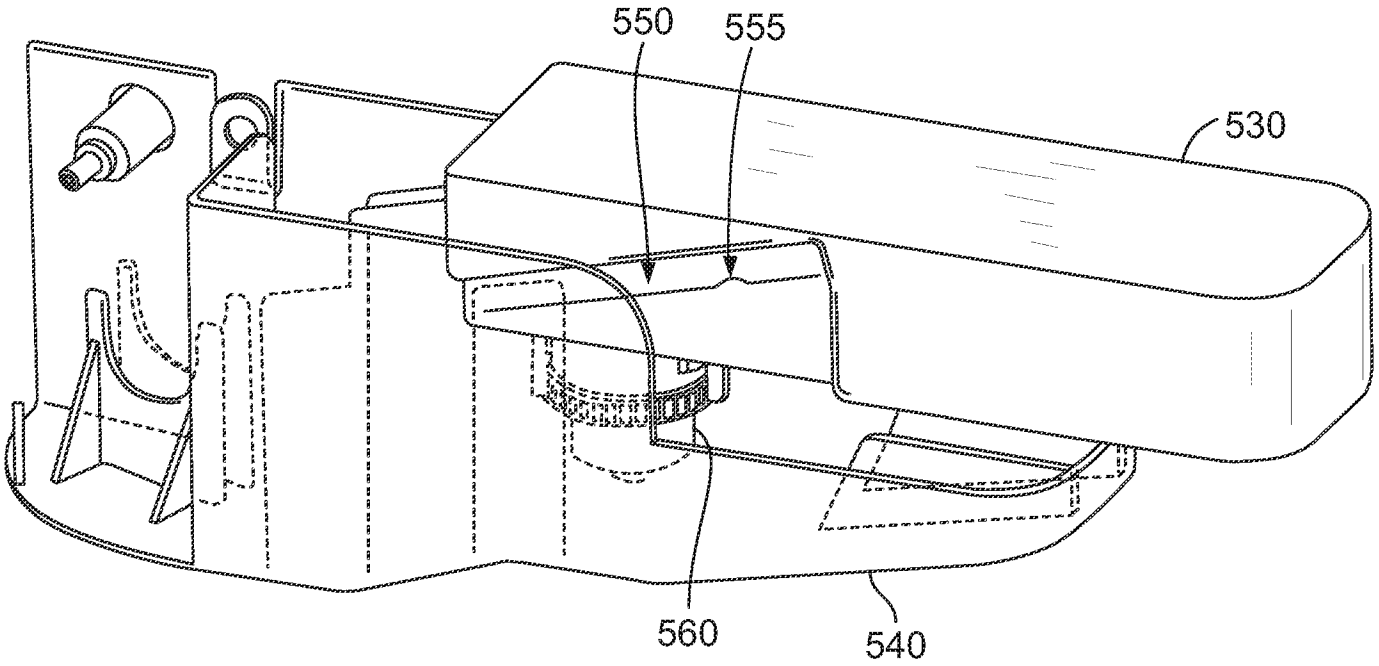
FIG. 11 illustrates a perspective view of a water tank assembly being slid into position into a docking station of the atomizer unit of FIG. 9.

FIG. 10 illustrates a perspective view of the atomizer unit 500. The atomizer unit 500 includes a water delivery assembly 520, a water tank assembly 530, a docking station 540, and a piezo cover 545 that snaps into place on the docking station 540. FIG. 11 illustrates a perspective view of the water tank assembly 530 being slid into position into the docking station 540.

As seen in FIGS. 9-11, the atomized spray from the atomizer unit 500 is dispersed at an angle from the vertical and not straight down. Also, the water tank assembly 530 includes a sliding face 550 that cooperates with the docking station 540 so that the water tank assembly 530 is slid at an angle into the docking station 540, and a locking projection 555 that helps secure the water tank assembly 530 in its final installed position. The water tank assembly 530 includes a cap assembly 560 that includes a valve allowing it to be open and closed. Water from the water tank assembly 530 is delivered to a reservoir in the docking station 540 from where water is delivered to the water delivery assembly via a flexible wick.

Various flexible wicks may be used in conjunction with different embodiments of the present disclosure. For example, in some embodiments the wick may be used to deliver fluid to an atomizer at an elevation a limited distance above the water reservoir. As will be appreciated by those skilled in the art, a wick may be used to draw a fluid upward a given distance based on, for example, the wick material and fluid being drawn.

Figure 12:
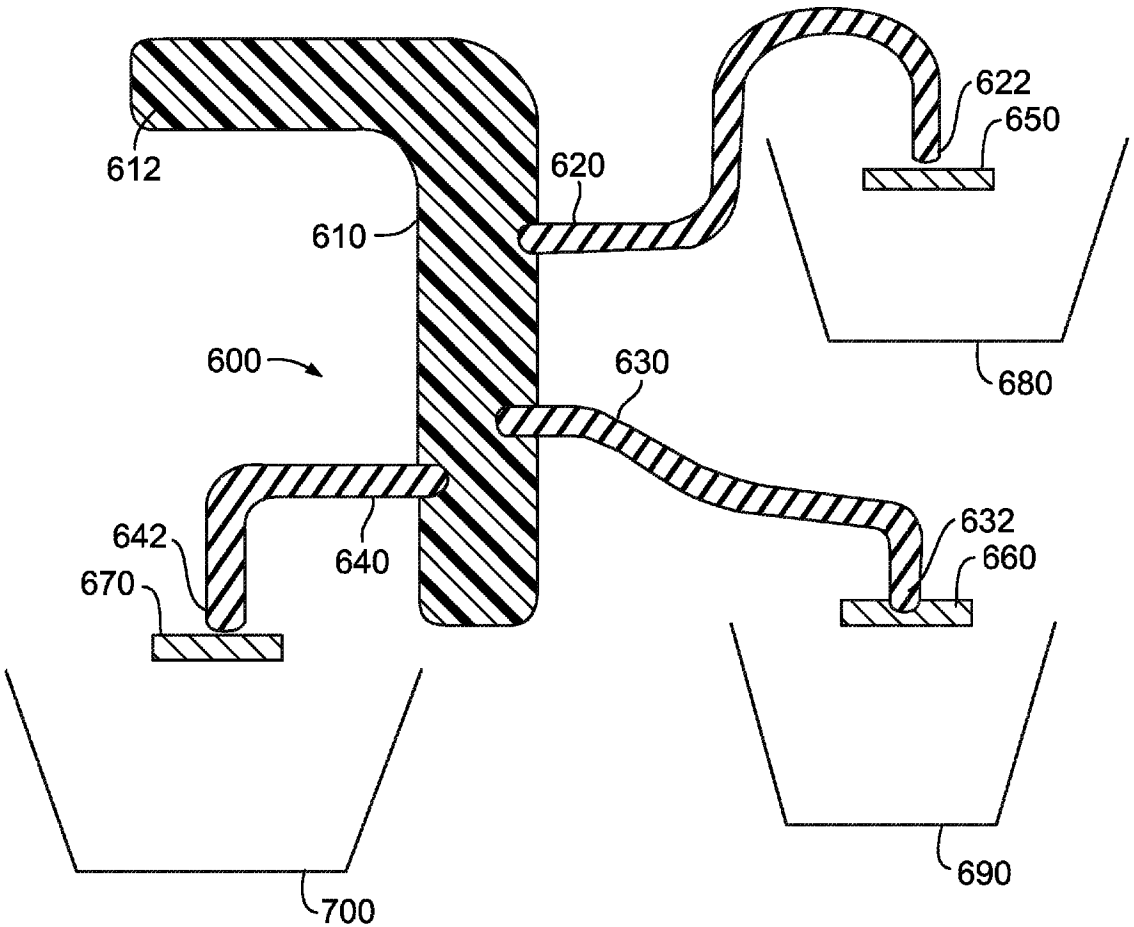
FIG. 12 illustrates a schematic view of a main wick with auxiliary wicks formed in accordance with an embodiment of the present disclosure.

FIG. 12 illustrates a view of a wick 600 formed in accordance with an embodiment of the present disclosure. The wick 600 may be used in a refrigeration system for providing fluid to a plurality of atomizers dispersed in different locations of a refrigerator. Such an arrangement can be used to provide atomization to separately located discrete portions of a refrigerator, and/or different amounts of atomization to different portions of a refrigerator, and/or atomization to different portions of a refrigerator at different times based upon, for example, different localized conditions. The wick includes a main wick 610 and auxiliary wicks 620, 630, and 640. Each of the auxiliary wicks 620, 630, and 640 provide liquid to atomizaters 650, 660, and 670, respectively. The atomizers 650, 660, 670 provide an atomized spray to compartments 680, 690, 700, respectively of the refrigerator.

Thus, each of the auxiliary wicks provides an example of a compartment wick, and the atomizers provide examples of compartment atomizers that are configured to deliver liquid to one of a plurality of compartments in a refrigerator. As an example, different numbers of auxiliary wicks may be used in other embodiments. As further examples, a primary wick may branch off to different locations in a refrigerator and there may be wicks that branch off from auxiliary wicks. In other embodiments, more than one wick and/or atomizer may provide fluid to a compartment.

In the illustrated embodiment, the main wick 610 includes a source end 612. The source end 612 is in fluid communication with a water source. Water is drawn from the source proximate the source end 612 through the main wick 610 to the auxiliary wicks 620, 630, and 640. Each of the auxiliary wicks 620, 630, and 640 include a terminal end 622, 632, and 642, respectively. Atomizers are located proximate to each of the terminal ends 622, 632, and 642. Water is provided to the atomizers from the source through the main wick from the source end 612 to the various auxiliary wicks, and then to the terminal ends of the auxiliary wicks, which provide the water to the atomizers, which may comprise, for example, piezo cells. In another embodiment, the main wick may also proceed to a terminal end that provides water to a piezo cell. Use of such a main wick and auxiliary wicks as discussed, for example, in connection with embodiments described above, allows water from a single source to be provided to different portions of a refrigerator, providing added flexibility and adjustability in water delivery.

As can be gathered from the foregoing, certain embodiments of the present disclosure thus can provide, for example, a modular assembly and/or sub-assemblies for the atomization of water in a refrigerator. Such a modular unit or units improves ease and cost of maintenance, assembly, and/or replacement. Further, certain embodiments of the present disclosure provide improved flexibility with respect to the location of water supply for an atomizer, and/or location of an atomizer or atomizers within a refrigerator. For example, multiple atomizers may be used that are supplied from a single water source, and/or atomizers can be positioned both above and below a water source. Atomizers can also be positioned at various remote distances from a water source, with water delivered via a wick. Use of multiple atomizers may allow discrete portions of a refrigerator to receive an atomized spray, as well as allow different portions to receive an atomized spray at different times and/or in different amounts.

As discussed above, the atomization unit 10 may be used to raise the moisture or humidity level in the interior of the refrigeration compartment of a refrigerator, for example. Further, a variable and/or user-controllable humidity level may be desirable. In this regard, it has been determined that a highly accurate estimate of moisture or humidity level may be obtained by analyzing one or more measured variables from the interior of the refrigeration compartment, as further discussed below. Further, because a value for the humidity level is available, a user may set a desired humidity level and the atomization unit 10 may be operated in a fashion to approximate the desired humidity level selected by the user.

Further, the humidifier and/or atomizer mentioned above may be switched on and off or otherwise controlled. Additionally, the humidifier and/or atomizer and/or its control system may be operated intermittently. Also, the humidifier and/or atomizer may be ultrasonic.

Figure 13:
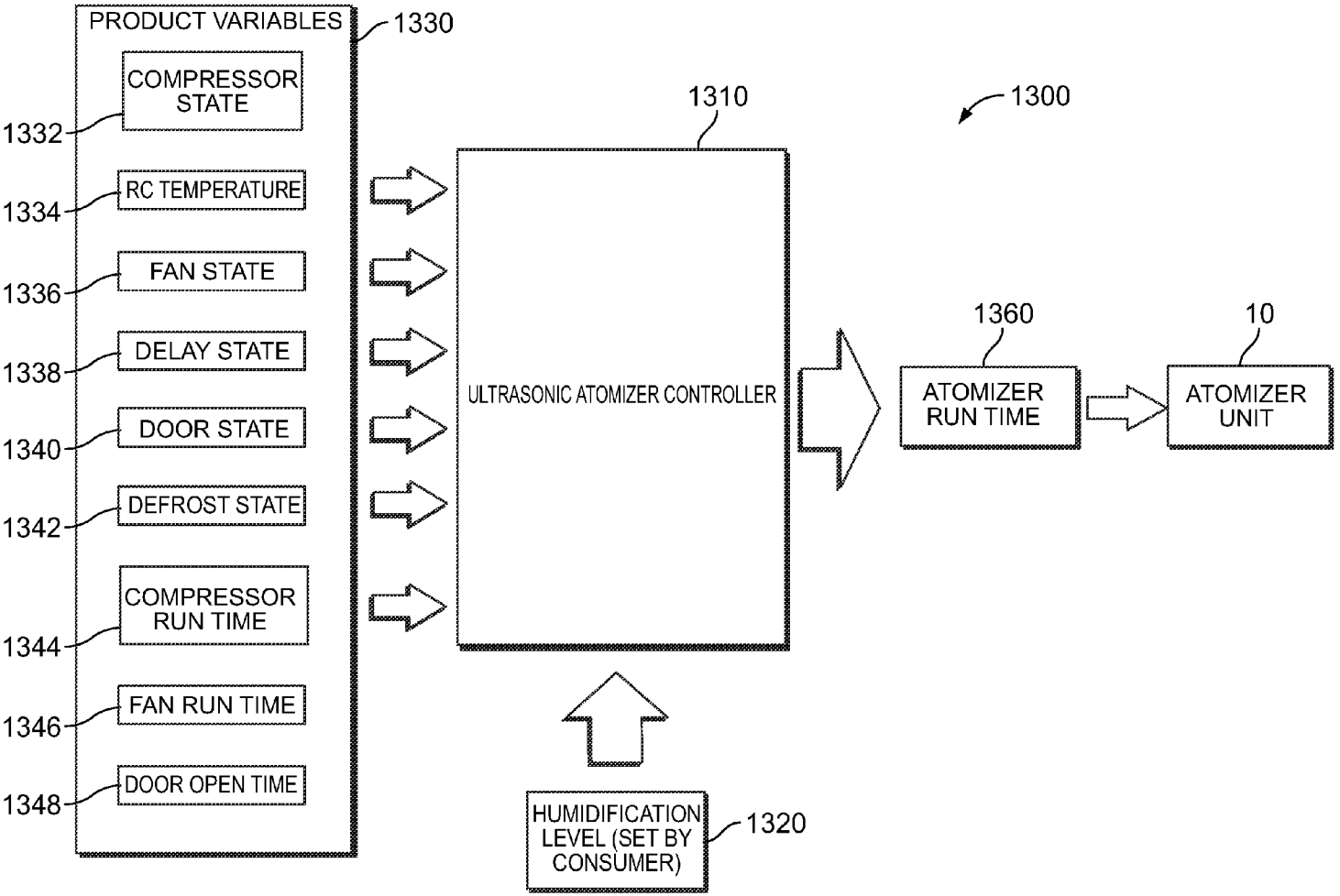
FIG. 13 illustrates a an embodiment of a multi-sense control system for humidity control in a refrigerator.

FIG. 13 illustrates an embodiment of a multi-sense control system 1300 for humidity control in a refrigerator. As shown in FIG. 13, the control system 1300 includes a controller 1310 that receives an input humidification level 1320 and a number of product variables 1330. The control system 1300 then determines an atomizer run time 1360 and the atomizer unit 10 is activated for the atomizer run time 1360.

More specifically, the input humidification level 1320 or moisture level may be set by a consumer. For example, a consumer may enter a number if value such as "46%" as a desired humidification level. Alternatively, the user may select one of a plurality of pre-set humidification levels. These pre-set humidification levels may be indicated by numeric values or by icons representing a favorable humidification level. For example, a lettuce icon may represent a predetermined humidification level that is beneficial to use with produce such as lettuce.

The product variables 1330 shown include the following, but the controller 1310 may be configured to use less than all of the following: Compressor state 1332 is an indication as to whether the compressor of the refrigeration element of the refrigerator is currently activated or not activated. The Compressor state 1332 may be directly observed, such as by an electrical signal from the compressor or indirectly observed, such as by a decrease in temperature or increase in power usage in the refrigerator.

RC temperature 1334 is a measurement of the temperature inside the refrigeration compartment of the refrigerator and may be determined from a thermometer or thermocouple.

Fan state 1336 is an indication as to whether the fan of the refrigeration element of the refrigerator is currently activated or not activated. The fan state 1336 may be directly observed, such as by an electrical signal from the compressor or indirectly observed, such as by a decrease in temperature or increase in power usage in the refrigerator.

The delay 1338 is a predetermined time delay that the controller 1310 applies between when the controller determines that activation of the atomizer unit 10 is warranted and when the atomizer unit is actually activated. Additionally, the delay may be adjustable. Additionally, as mentioned above, the atomizer may be an ultrasonic atomizer such as a piezo, for example.

The Door state 1340 is an indication as to whether the door to the refrigeration compartment is currently open or closed. The door state may be directly observed by a signal from a switch that is depressed when the door is closed.

The defrost state 1342 is an indication as to whether the refrigerator is currently in a defrost operation. The status of the defrost operation may be directly observed by a signal from the refrigerator's defrost system.

The compressor run time 1344 is an indication of how long the compressor has been activated if the compressor is currently activated, or how lone the compressor has been deactivated if the compressor is deactivated. The compressor run time may be observed by providing an electrical signal from the compressor to a timing system.

The fan run time 1346 is similar to the compressor run time 1344 and provides an indication of how long the fan has been running or has been off.

The door open time 1348 is also similar to the compressor run time and fan run time and provides an indication of how long the door has been open or closed.

As mentioned above, in an embodiment, all of the product variables 1330 may be passed to the control system 1300. The control system then determines an amount of time to activate the humidification system, in this example, the atomizer unit 10. Alternatively, the control system 1300 may be useful with a humidification or moisture-producing system other then an atomizer and other than an ultrasonic atomizer, as long as the control system 1300 is configured for the specifics characteristics of the humidification system, such as moisture per unit of time produced by the humidification system.

The control system 1300 may determine the atomizer run time 1360 in a variety of different ways and using several different product variables, as further described below. Also, the atomizer run time 1360 may be used by the controller 1310 to activate the atomizer unit 10 directly, or may be passed to a timer that activates the atomizer unit for that time. Alternatively, the atomizer unit 10 may automatically run for a predetermined time in response to an activation signal from the controller 1310.

Figure 15B:
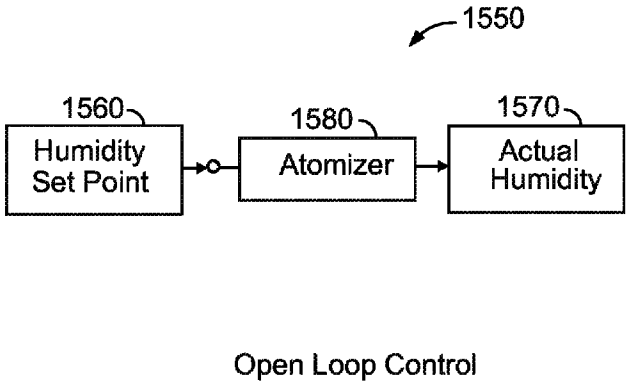
FIGS. 15A and 15B show two strategies for controlling the refrigerator humidity level: a closed-loop control approach with humidity feedback and an open loop control approach.
Figure 15A:
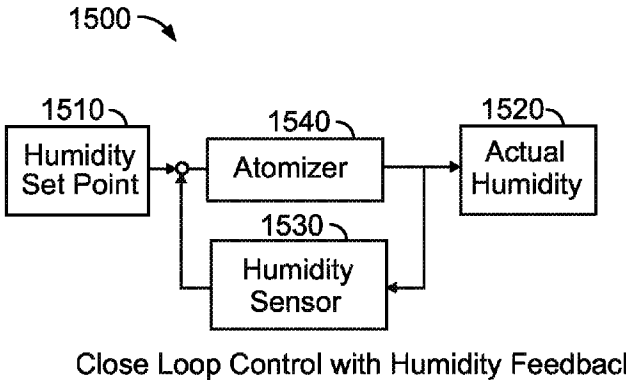

FIGS. 15A and 15B show two strategies for controlling the refrigerator humidity level: a closed-loop control approach with humidity feedback 1500 and an open loop control approach 1550. In the closed-loop control with humidity feedback 1500, first, at step 1510 a humidity set point is established by the user or the manufacturer. Next, the actual humidity 1520 is determined by the humidity sensor 1530 and compared to the humidity set point 1510. In one embodiment, the atomizer 1540 turns on when the actual humidity level is below the humidity cut-in point and turns off when the actual humidity level is above the humidity cut-off point. The humidity cut-in point is the user set point of humidity minus a constant value, or a dead band. For example, the dead band may be 1-5% humidity. In one embodiment, the humidity cut-off point is the user set point plus the dead band. Consequently, the need for humidification may be determined by the difference between the actual humidity and the user set point in a closed-loop control with humidity feedback.

In an open loop control 1550, there is typically no direct feedback of the actual humidity level inside the refrigerator, or refrigerator compartments. Instead, an adaptive method is created to estimate the amount of moisture that should be added to the air in the targeted compartments to maintain the desired humidity level. In one embodiment, this method is based on the physical understanding of mass transfer or moisture transfer inside a refrigerator. For example, moisture from the ambient air migrates into the refrigerator during door openings. The more food there is in the refrigerator, the more moisture is typically produced. On the other hand, more food may require a longer compressor run time to reduce the temperature in the refrigeration compartment.

Thus, in the open loop control 1550, first, at step 1560 a humidity set point is established by the user or the manufacturer. The actual humidity 1560 not directly measured, but in one embodiment the atomizer 1580 turns on when the estimated humidity level is below the humidity cut-in point and turns off when the estimated humidity level is above the humidity cut-off point. As in the example above, the humidity cut-in point is the user set point of humidity minus a constant value, or a dead band. For example, the dead band may be 1-5% humidity. In one embodiment, the humidity cut-off point is the user set point plus the dead band. Consequently, the need for humidification may be determined by the difference between the estimated humidity and the user set point in an open-loop system.

Consequently, the frequency of door opening and the maximum compressor continuous run time provide some information about the "sources" of moisture. On the other hand, there are also "moisture sinks" in a refrigerator, where moisture is removed. The evaporator in a refrigerator acts as such a "moisture sink", where the moisture amount in the air is reduced as it passes through the evaporator, because the evaporator surface temperature is usually much lower than the dew point of the air. Consequently, the amount of moisture that is removed by the evaporator is at least in part dependent of the accumulative compressor run time. The amount of moisture that is removed from the air inside the refrigerator may also be estimated from the refrigerator defrost data. For instance, the time that was required for the previous defrost may depend on the amount of frost or moisture accumulated on the evaporator. Consequently, the longer the interval between the last two defrost runs, the more frost or moisture is typically on the evaporator. Consequently, in one or more embodiments, the amount of moisture that is added back by the atomizer may be determined by Equation 1:

$$M_{atomizer}=f(HL,CRT,RCT,DOT,TDB,DT,MCRT) \quad \text{Equation 1}$$

Where:

$M_{atomizer}$=Amount of moisture per atomizer run

HL=Humidity level set point

CRT=Accumulative Compressor Run Time

RCT=Refrigeration Compartment Temperature

DOT=Accumulative Door Opening Time, # of opening times the average opening time.

TDB=Time between defrost in the previous defrost cycle

DT=Defrost time in the previous defrost

MCRT=Maximum Compressor Continuous Run Time

If the atomizer has a constant atomization rate of r [grams/s], then the atomizer or humidifier run time may be determined by Equation 2:

$$AT_{on} = \frac{M_{atomizer}}{r} = \frac{1}{r} f(HL, CRT, RCT, DOT, TDB, DT, MCRT) \quad \text{Equation 2}$$

Consequently, after determining the amount moisture that needs to be added to the air using the equations above, we may now determine when to turn on the atomizer. There are at least two approaches. The first approach is the atomizer run schedule. For example, in a simple schedule the atomizer may be activated once every hour, however additional intervals of half-hour, two-hour, 10-minute, and 15 minute may also be used. We can also have several time schedules pre-programmed in the controls for users to select.

The second approach is to compare $AT_{on}$ with a reference value AT_on_ref. The atomizer may then be activated when $At_{on}$>AT_on_ref.

Figure 14B:
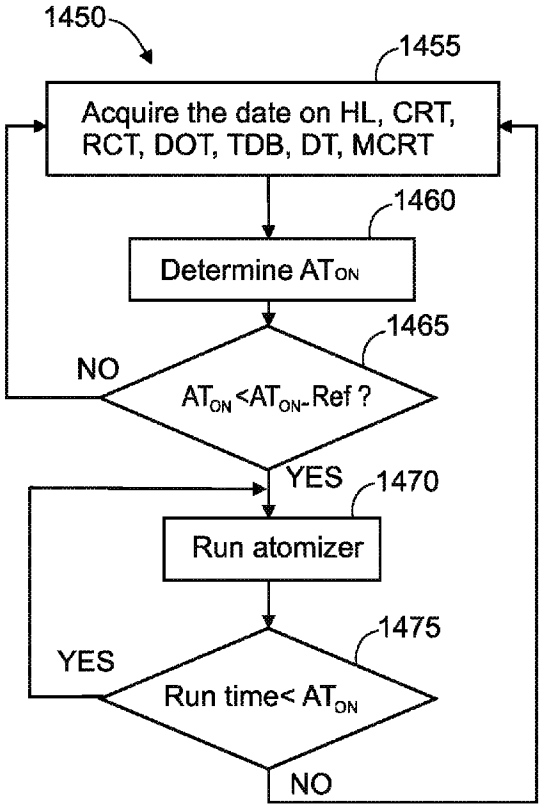
FIGS. 14A and 14B illustrate a time schedule flowchart and an atomizer on-time reference flowchart for an embodiment of determining the operation of the atomizer.
Figure 14A:
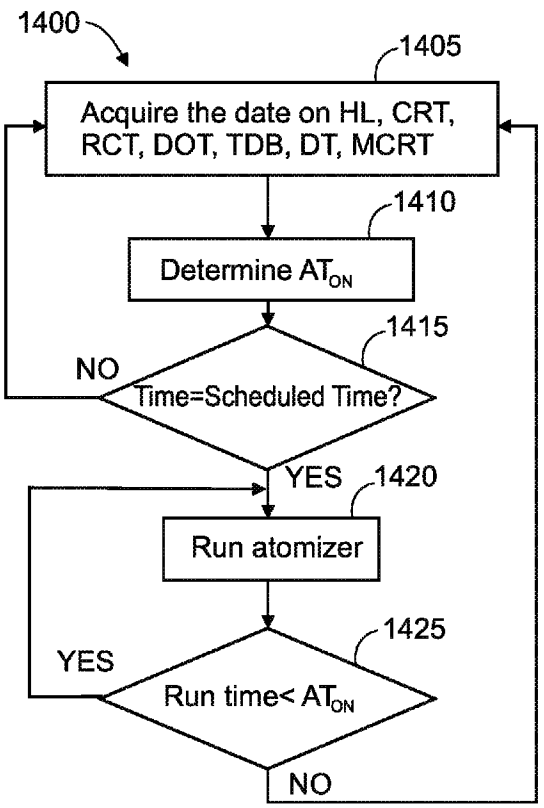

FIGS. 14A and 14B illustrate a time schedule flowchart 1400 and an atomizer on-time reference flowchart 1450 for an embodiment of determining the operation of the atomizer.

Turning to the time schedule approach flowchart 1400, first at step 1405 the data for Hl, CRT, RCT, DOT, TDB, DT, and MCRT are acquired. Next, at step 1410, the atomizer on time is determined based on Equation 2, above. Next, at step 1415, a timer is consulted to determine whether the current time is the scheduled time to turn on the atomizer. If the current time is not the scheduled time, then the flowchart proceeds back to step 1405. Conversely, if the current time is the scheduled time, then the flowchart proceeds to step 1420 and the atomizer is activated.

Next, at step 1425, the time that the atomizer is activated is measured and compared to the atomizer on time as determined at step 1410. If the atomizer has been on for less than the calculated atomizer on time, then the flowchart proceeds to step 1420 and the atomizer continues running. Conversely, if the actual atomizer on time equals or exceeds the calculated atomizer run time, then the atomizer is deactivated and the process proceeds back to step 1405.

Turning to the atomizer on-time reference approach as shown in flowchart 1450, first at step 1455 the data for Hl, CRT, RCT, DOT, TDB, DT, and MCRT are acquired. Next, at step 1460, the atomizer on time is determined based on Equation 2, above. Next, at step 1465, the actual atomizer on time is compared to a reference atomizer on time. If the actual atomizer on time is less than the reference atomizer on time, then the flowchart proceeds back to step 1455. Conversely, if the actual atomizer on time is equal to or greater than the reference atomizer on time, the flowchart proceeds to step 1470 and the atomizer is activated.

Next, at step 1475, the time that the atomizer is activated is measured and compared to the atomizer on time as determined at step 1460. If the atomizer has been on for less than the calculated atomizer on time, then the flowchart proceeds to step 1470 and the atomizer continues running. Conversely, if the actual atomizer on time equals or exceeds the calculated atomizer run time, then the atomizer is deactivated and the process proceeds back to step 1455.

Thus, as discussed above, the system and method uses information from the refrigerator to better estimate what the relative humidity is in a compartment. The parameters may include: Room temperature, Compartment Temperature, Product Settings, Defrost history, and Door openings. In one embodiment, the parameters, associated with regression data from tests done in several operating conditions help estimate current relative humidity and consequently the need for water atomization.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

The invention claimed is:

1. A method for actuating a humidifier to provide humidification to the interior of a refrigeration compartment, said method including:

storing a predetermined desired humidity level for the interior of the refrigeration compartment;

measuring the temperature in the interior of said refrigeration compartment;

determining the length of time since the last defrost operation in said refrigeration compartment;

determining the length of time since door to said refrigeration compartment was last opened;

determining a compressor time by performing at least one of:

determining the length of time a compressor has been operating, wherein said compressor operates to provide refrigeration for the interior of said refrigeration compartment;

determining the length of time since said compressor ended operation;

calculating an estimated humidity level for the interior of said refrigeration compartment based at least in part on said temperature in the interior of said refrigeration compartment, said length of time since the last defrost operation, the length of time since the door to said refrigeration compartment was last opened, and said compressor time; and actuating said humidifier when said estimated humidity level is less than said predetermined desired humidity level.

2. The method of claim 1 wherein said predetermined humidity level is set by a user.

3. The method of claim 2 wherein said predetermined humidity level is adjustable.

4. The method of claim 1 wherein actuating said humidifier includes operating said humidifier for a calculated amount of time based on the comparison of said estimated humidity level to said predetermined desired humidity level.

5. The method of claim 1 wherein said humidifier is an atomizer.

6. The method of claim 5 wherein said atomizer is ultrasound-based.

7. The method of claim 6 wherein said atomizer is a microfilm ultrasound water atomizer.

8. A control system for actuating a humidifier providing humidification to the interior of a refrigeration compartment, said system including:

a humidification setting memory for storing a predetermined desired humidity level for the interior of the refrigeration compartment;

a thermometer for measuring the interior temperature of said refrigeration compartment;

a defrost timer for measuring the time since last defrost operation in said refrigeration compartment a door timer for determining the length of time since door to said refrigeration compartment was last opened;

a compressor timer determining the length of time a compressor has been operating and determining the length of time since said compressor ended operation, wherein said compressor operates to provide refrigeration for the interior of said refrigeration compartment;

a humidity estimator, wherein said humidity estimator calculates an estimated humidity level for the interior of said refrigeration compartment based at least in part on said temperature in the interior of said refrigeration compartment, said length of time since the last defrost operation, the length of time since the door to said refrigeration compartment was last opened, and said compressor time;

a humidity comparator, wherein said humidity comparator retrieves said predetermined desired humidity level from said humidification setting memory and compares it to said estimated humidity level, wherein said humidity comparator generates a humidifier actuation command when said estimated humidity level is less than said predetermined desired humidity level; and a humidifier actuator for actuating said humidifier in response to said humidifier actuation command.

9. The system of claim 8 wherein said predetermined humidity level is set by a user.

10. The system of claim 9 wherein said predetermined humidity level is adjustable.

11. The system of claim 8 wherein said humidity comparator also determines an amount of time for said humidifier to be actuated and operating said humidifier for that amount of time.

12. The system of claim 8 wherein said humidifier is an atomizer.

13. The system of claim 12 wherein said atomizer is ultrasound-based.

14. The system of claim 13 wherein said atomizer is a microfilm ultrasound water atomizer.

15. A humidification system providing humidification to the interior of a refrigeration compartment, said system including:

a humidifier receiving a humidifier actuation command and providing humidification to the interior of a refrigeration compartment in response to said humidifier actuation command, wherein said humidifier actuation command is determined based on a comparison of a predetermined desired humidity level for the interior of said refrigeration compartment to an estimated humidity level, wherein said estimated humidity level is determined based at least in part on the temperature in the interior of said refrigeration compartment, the length of time since the last defrost operation, the length of time since a door to said refrigeration compartment was last opened, and a compressor time, wherein said compressor time is based on the length of time a compressor has been operating, and the length of time since said compressor ended operation.

16. The system of claim 15 wherein said predetermined humidity level is set by a user.

17. The system of claim 16 wherein said predetermined humidity level is adjustable.

18. The system of claim 15 wherein said humidifier is an atomizer.

19. The system of claim 18 wherein said atomizer is ultrasound-based.

20. The system of claim 19 wherein said atomizer is a microfilm ultrasound water atomizer.

* * * * *